US010161355B2

(12) United States Patent
Xia

(10) Patent No.: US 10,161,355 B2
(45) Date of Patent: Dec. 25, 2018

(54) EFFICIENT STIRLING ENGINE

(71) Applicant: JIANGSU SOURCE WING ELECTRIC CO., LTD, Zhenjiang, Jiangsu (CN)

(72) Inventor: Zhijun Xia, Jiangsu (CN)

(73) Assignee: JIANGSU SOURCE WING ELECTRIC CO., LTD., Zhenjiang, Jiangsu (CN)

( * ) Notice: Subject to any disclaimer, the term of this patent is extended or adjusted under 35 U.S.C. 154(b) by 45 days.

(21) Appl. No.: 15/545,504

(22) PCT Filed: Jan. 17, 2017

(86) PCT No.: PCT/CN2017/071454
§ 371 (c)(1),
(2) Date: Jul. 21, 2017

(87) PCT Pub. No.: WO2017/125005
PCT Pub. Date: Jul. 27, 2017

(65) Prior Publication Data

US 2018/0051651 A1 Feb. 22, 2018

(30) Foreign Application Priority Data

Jan. 19, 2016 (CN) ..... 2016 1 0035720

(51) Int. Cl.

| | |
|---|---|
| ***F02G 1/043*** | (2006.01) |
| ***F02G 1/05*** | (2006.01) |
| ***F02G 1/057*** | (2006.01) |
| ***F02G 1/044*** | (2006.01) |
| ***F02G 1/055*** | (2006.01) |

(52) U.S. Cl.
CPC ..... *F02G 1/044* (2013.01); *F02G 1/043* (2013.01); *F02G 1/05* (2013.01); *F02G 1/055* (2013.01);

(Continued)

(58) Field of Classification Search
CPC . F02G 1/043; F02G 1/044; F02G 1/05; F02G 1/055; F02G 1/057;

(Continued)

(56) References Cited

U.S. PATENT DOCUMENTS 3,145,527 A * 8/1964 Morgenroth ..... F02G 1/043 60/522
3,218,815 A * 11/1965 Chellis ..... F25B 9/14 62/6

(Continued)

FOREIGN PATENT DOCUMENTS

CN 101021187 8/2007
CN 101280737 10/2008

(Continued)

OTHER PUBLICATIONS

International Search Report filed in PCT/CN2017/071454 dated Apr. 11, 2017.

*Primary Examiner* — Mark Laurenzi
*Assistant Examiner* — Xiaoting Hu
(74) *Attorney, Agent, or Firm* — Rankin, Hill & Clark LLP

(57) ABSTRACT

An efficient stirling engine comprises an expansion chamber with a heater and a compression chamber with a cooler, wherein the two chambers are connected through a regenerator. A passage between the heater and the expansion chamber is provided with a first valve system, a passage between the cooler and the compression chamber is provided with a second valve system, the first valve system can close or open the passage between the heater and the expansion chamber, and the second valve system can close or open the passage between the cooler and the compression chamber. After adopting the structure above, when a heating end is heated to expand, a cooling end at the other end is closed, and on the contrary, when the cooling end is cooled (Continued)

to shrink, the heating end at the other end is closed, so that the heating energy is fully used, so as to increase the efficiency of the stirling engine.

7 Claims, 1 Drawing Sheet

(52) U.S. Cl.
CPC ..... *F02G 1/057* (2013.01); *F02G 2242/10* (2013.01); *F02G 2243/30* (2013.01); *F02G 2243/34* (2013.01); *F02G 2253/04* (2013.01); *F02G 2270/30* (2013.01); *F02G 2270/90* (2013.01)

(58) Field of Classification Search
CPC ..... F02G 2243/30–2243/40; F02G 2242/10; F02G 2242/32; F02G 2270/30; F02G 2270/90
See application file for complete search history.

(56) References Cited

U.S. PATENT DOCUMENTS 3,318,100 A * 5/1967 Fokker ..... F02G 1/043 62/6
3,717,004 A * 2/1973 O'Neil ..... F02G 1/0445 60/517
4,622,813 A * 11/1986 Mitchell ..... F02G 1/043 60/522
4,774,808 A * 10/1988 Otters ..... F02G 1/043 60/517
4,945,726 A * 8/1990 Beale ..... F02G 1/0435 60/520
2003/0196424 A1* 10/2003 Warren ..... F02B 75/02 60/39.6
2009/0056329 A1* 3/2009 Takeuchi ..... F02G 1/053 60/520
2015/0101324 A1* 4/2015 Song ..... F02G 1/044 60/525

FOREIGN PATENT DOCUMENTS

| | | |
|---|---|---|
| CN | 101482071 | 7/2009 |
| CN | 102661256 | 9/2012 |
| CN | 105508076 | 4/2016 |
| CN | 105508078 | 4/2016 |
| CN | 205349547 | 6/2016 |
| CN | 205349549 | 6/2016 |
| DE | 102006013468 | 9/2007 |
| EP | 2189645 | 5/2010 |
| JP | H109151795 | 6/1997 |

* cited by examiner

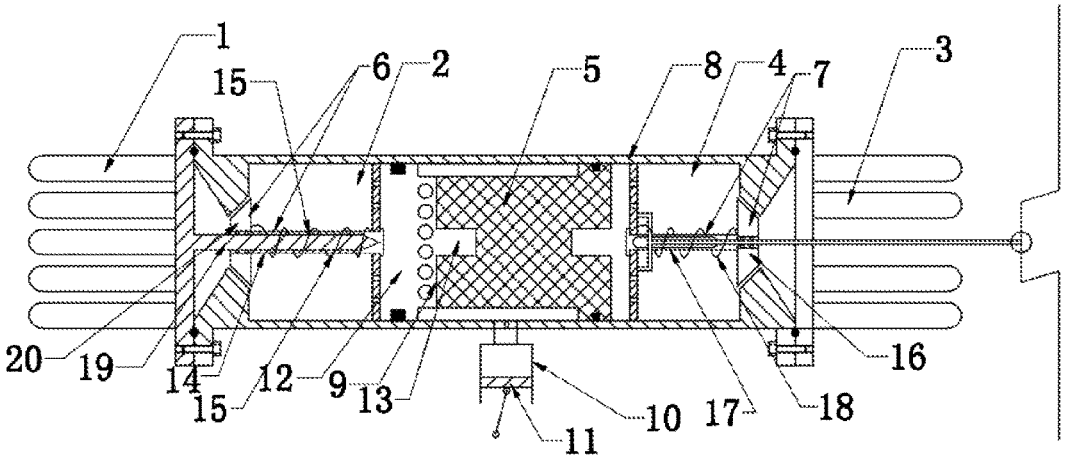
1
15
6
2
5
8
4
7
3
20
19
14
15
12
9
13
10
11
17
18
16

EFFICIENT STIRLING ENGINE

TECHNICAL FIELD

The utility model relates to improvements on a Stirling engine, and more particularly, to an efficient stirling engine.

BACKGROUND

The traditional stirling engine is generally composed of a shifting air cylinder as well as a heater and a cooler arranged at two ends of the shifting air cylinder. The shifting air cylinder is internally provided with a shifting air piston to divide the shifting air cylinder into a heating chamber and a cooling chamber. The two chambers are connected through a regenerative heating passage. However, the structure design of the existing stirling engine is unreasonable; when a power piston is pushed to act through heating and expanding, a part of heat energy enters a cooling end through a regenerator, and the heat energy is neutralized, which leads to the restriction on the efficiency of the stirling engine, so that the stirling engine cannot be popularized for using.

SUMMARY

A technical problem to be solved by the utility model is to provide an efficient stirling engine that can fully use the heating energy to increase the efficiency of the stirling engine.

In order to solve the technical problem above, the efficient stirling engine according to the utility model comprises an expansion chamber with a heater and a compression chamber with a cooler, wherein the two chambers are connected through a regenerator. A passage between the heater and the expansion chamber is provided with a first valve system, a passage between the cooler and the compression chamber is provided with a second valve system, the first valve system can close or open the passage between the heater and the expansion chamber, and the second valve system can close or open the passage between the cooler and the compression chamber.

The expansion chamber and the compression chamber are located in a shifting air cylinder, and the shifting air cylinder is internally provided with a shifting air piston capable of moving back and forth in the shifting air cylinder.

The regenerator is arranged in the shifting air piston.

Both the first valve system and the second valve system comprise a valve body and a guide rod arranged on the valve body, a tail end of the guide rod is located inside the shifting air piston, and a spring is arranged between the valve system and the shifting air piston; the first valve system can close or open the passage between the heater and the expansion chamber under the driving of the shifting air piston; and the second valve system can close or open the passage between the cooler and the compression chamber under the driving of the shifting air piston.

The shifting air piston is provided with piston rings located at two sides of the shifting air piston, the shifting air piston is also provided with a ring slot between the piston rings at the two sides, the shifting air cylinder is provided with a power cylinder communicated with the shifting air cylinder, the power cylinder is internally provided with a power piston capable of externally acting in the power cylinder, and when the power cylinder is located at a limit position where the shifting air piston moves to in left and right, an entrance on an upper end of the power cylinder is still in the interval of the ring slot of the shifting air piston.

Both end faces at the two sides of the shifting air piston are designed into a hollow structure, an empty cavity is arranged between the end face located at one side of the compression chamber in the shifting air piston and the regenerator in the shifting air piston, and a via hole is arranged between the empty cavity and the ring slot of the shifting air piston.

End faces at left and right sides of the regenerator are provided with guide holes corresponding to the guide rods.

Two ends of the shifting air cylinder are provided with taper faces respectively, the valve body has an outer contour which can be matched with the taper faces, the guide rod is set to be a hollow structure, the guide rod of the first valve system is internally provided with an inner guide rod, and a linear bearing is arranged between the valve body of the first valve system and the inner guide rod; the guide rod of the second valve system is internally provided with a shifting air piston rod, and a linear bearing is arranged between the valve body of the second valve system and the shifting air piston rod.

The guide rod of the second valve system is provided with through holes arranged in an axial symmetry manner, the shifting air piston rod is connected with a connecting piece passing through the through holes, and the connecting piece is fixedly connected with the shifting air piston.

After adopting the structure above, when a heating end is heated to expand, a cooling end at the other end is closed, and on the contrary, when the cooling end is cooled to shrink, the heating end at the other end is closed, so that the heating energy is fully used, so as to increase the efficiency of the stirling engine.

BRIEF DESCRIPTION OF THE DRAWINGS

FIG. 1 is a structural diagram of an efficient stirling engine according to the utility model.

DETAILED DESCRIPTION

An efficient stirling engine according to the utility model is further described in details hereinafter with reference to the drawings and the detailed descriptions.

As shown in the FIGURE, the efficient stirling engine according to the utility model comprises an expansion chamber 2 with a heater 1 and a compression chamber 4 with a cooler 3, wherein the two chambers are connected through a regenerator 5. A passage between the heater 1 and the expansion chamber 2 is provided with a first valve system 6, a passage between the cooler 3 and the compression chamber 4 is provided with a second valve system 7, the first valve system 6 can close or open the passage between the heater and the expansion chamber, and the second valve system 7 can close or open the passage between the cooler 3 and the compression chamber 4.

Wherein, in the embodiment, the expansion chamber 2 and the compression chamber 4 are located in a shifting air cylinder 8, the shifting air cylinder 8 is internally provided with a shifting air piston 9 capable of moving back and forth in the shifting air cylinder, and the regenerator 5 is arranged in the shifting air piston 9; the first valve system 6 comprises a first valve body 20 and a first guide rod 14 arranged on the first valve body, and a tail end of the first guide rod 14 is located inside the shifting air piston; it can be seen from the FIGURE that the tail end of the first guide rod 14 is also provided with a limiting boss located inside the shifting air piston, and a first spring 15 installed on the first guide rod 14 is arranged between the first valve body 20 and the shifting air piston 9; in addition, the first spring 15 may also be arranged between the regenerator and a limiting boss arranged at the tail end of the first guide rod 14, the first valve system 6 can close or open the passage between the heater and the expansion chamber under the driving of the shifting air piston; the second valve system 7 comprises a second valve body 16 and a second guide rod 17 installed on the second valve body, the tail end of the second guide rod 17 is located inside the shifting air piston, and it can be seen from the FIGURE that the tail end of the second guide rod 17 is also provided with the limiting boss located inside the shifting air piston, and a second spring 18 installed on the second guide rod 17 is arranged between the second valve body 16 and the shifting air piston 9; in addition, the second spring 18 may also be arranged between the regenerator and the limiting boss arranged at the tail end of the second guide rod 17, the second valve system 7 can close or open the passage between the cooler and the compression chamber 4 under the driving of the shifting air piston; the two sides of the shifting air cylinder 8 are provided with taper faces respectively, both the first valve body 20 and the second valve body 16 have an outer contour which can be matched with the taper face respectively, both the first guide rod 14 and the second guide rod 17 are set to be a hollow structure, the first guide rod 14 is internally provided with an inner guide rod 19, a linear bearing is installed between the first valve body 20 and the inner guide rod 19, so that the first valve system 6 can move linearly in a reciprocating manner along the inner guide rod 20; the second guide rod 17 is internally provided with a shifting air piston rod, and a linear bearing is installed between the second valve body 16 and the shifting air piston rod, so that the second valve system 7 can move linearly in a reciprocating manner along the shifting air piston rod.

Further, the shifting air piston 9 is provided with piston rings located at two sides of the shifting air piston, the shifting air piston 9 is also provided with a ring slot between the piston rings at two sides, the shifting air cylinder 8 is provided with a power cylinder 10 communicated with the shifting air cylinder, the power cylinder 10 is internally provided with a power piston 11 capable of externally acting in the power cylinder, when the power cylinder 10 is located at a limit position where the shifting air piston moves to in left and right, an entrance on an upper end of the power cylinder is still in the terminal of the ring slot of the shifting air piston. End faces at two sides of the shifting air piston 9 are designed into a hollow structure, an empty cavity 12 is arranged between the end face located at one side of the expansion chamber 2 in the shifting air piston 9 and the regenerator in the shifting air piston, and a via hole is arranged between the empty cavity and the ring slot of the shifting air piston. End faces at left and right sides of the regenerator 5 are provided with guide holes 13 corresponding to the guide rods, and the end face at one side of the compression chamber 4 in the shifting air piston 9 is provided with the shifting air piston rod arranged at the center of the guide rod. The guide rod of the second valve system 7 is provided with through holes arranged in an axial symmetry manner, the shifting air piston rod is connected with a connecting piece passing through the through holes, and the connecting piece is fixedly connected with the shifting air piston.

The invention claimed is:

1. An efficient stirling engine, comprising an expansion chamber with a heater and a compression chamber with a cooler, wherein the two chambers are connected through a regenerator, a passage between the heater and the expansion chamber is provided with a first valve system, a passage between the cooler and the compression chamber is provided with a second valve system, the first valve system closes or opens the passage between the heater and the expansion chamber, and the second valve system closes or opens the passage between the cooler and the compression chamber;

wherein the expansion chamber and the compression chamber are located in a shifting air cylinder, and the shifting air cylinder is internally provided with a shifting air piston capable of moving back and forth in the shifting air cylinder;

wherein each of the first valve system and the second valve system comprises a valve body and a guide rod arranged on the valve body, a tail end of the guide rod is located inside the shifting air piston, and a spring is arranged between the respective valve system and the shifting air piston; the first valve system closes or opens the passage between the heater and the expansion chamber under the driving of the shifting air piston; and the second valve system closes or opens the passage between the cooler and the compression chamber under the driving of the shifting air piston.

2. The efficient stirling engine according to claim 1, wherein the regenerator is arranged in the shifting air piston.

3. The efficient stirling engine according to claim 2, wherein the shifting air piston is provided with piston rings located at two sides of the shifting air piston, the shifting air piston is also provided with a ring slot between the piston rings at the two sides, the shifting air cylinder is provided with a power cylinder communicated with the shifting air cylinder, the power cylinder is internally provided with a power piston capable of externally acting in the power cylinder, and when the power cylinder is located at a limit position where the shifting air piston moves left and right, an entrance on an upper end of the power cylinder is still in communication with the ring slot of the shifting air piston.

4. The efficient stirling engine according to claim 3, wherein both end faces at the two sides of the shifting air piston are formed into a hollow structure, an empty cavity is arranged between the end face located at the side of the expansion chamber in the shifting air piston and the regenerator in the shifting air piston, and a via hole is arranged between the empty cavity and the ring slot of the shifting air piston.

5. The efficient stirling engine according to claim 4, wherein end faces at left and right sides of the regenerator are provided with guide holes corresponding to the guide rods.

6. The efficient stirling engine according to claim 5, wherein two ends of the shifting air cylinder are provided with taper faces respectively, the valve body has an outer contour which is matched with the taper faces, the guide rod is set to be a hollow structure, the guide rod of the first valve system is internally provided with an inner guide rod, and a linear bearing is arranged between the valve body of the first valve system and the inner guide rod; the guide rod of the second valve system is internally provided with a shifting air piston rod, and a linear bearing is arranged between the valve body of the second valve system and the shifting air piston rod.

7. The efficient stirling engine according to claim 6, wherein the guide rod of the second valve system is provided with through holes arranged in an axial symmetry manner, the shifting air piston rod is connected with a connecting piece passing through the through holes, and the connecting piece is fixedly connected with the shifting air piston.

* * * * *